US005439134A

United States Patent [19]

Tsuda et al.

[11] Patent Number: 5,439,134

[45] Date of Patent: Aug. 8, 1995

[54] FOOD STORAGE AND DELIVERY DEVICE

[75] Inventors: Kiichiro Tsuda, Kanagawa; Seiitsu Kin, Tokyo; Toru Kajimura, Mie, all of Japan

[73] Assignee: Fuji Electric Co., Ltd., Kawasaki, Japan

[21] Appl. No.: 221,967

[22] Filed: Apr. 4, 1994

[30] Foreign Application Priority Data

Apr. 6, 1993 [JP] Japan ..... 5-078384

[51] Int. Cl.[6] ..... G07F 11/58

[52] U.S. Cl. ..... 221/75; 221/79; 221/195; 221/225; 221/253; 221/DIG. 1

[58] Field of Search ..... 221/75, DIG. 1, 130, 221/131, 133, 79, 123, 124, 129, 191, 194, 195, 206, 225, 236, 237, 253, 258, 262

[56] References Cited

U.S. PATENT DOCUMENTS

| | | | |
|---|---|---|---|
| 3,178,055 | 4/1965 | Schuller | 221/130 X |
| 3,999,682 | 12/1976 | Albright et al. | 221/75 |
| 4,023,704 | 5/1977 | Pitel et al. | 221/281 X |
| 4,252,250 | 2/1981 | Toth | 221/195 X |
| 4,560,088 | 12/1985 | Tan | 221/75 |
| 5,186,355 | 2/1993 | VonDelinde et al. | 221/75 |

FOREIGN PATENT DOCUMENTS

| | | | |
|---|---|---|---|
| 58-81684 | 6/1983 | Japan . | |
| 63-163586 | 10/1988 | Japan . | |
| 1250193 | 10/1989 | Japan | 221/130 X |
| 2183392 | 7/1990 | Japan | 221/130 X |

*Primary Examiner*—William E. Terrell
*Assistant Examiner*—Dean A. Reichard
*Attorney, Agent, or Firm*—Kanesaka & Takeuchi

[57] ABSTRACT

A food storage and delivery device is formed of a reservoir for food items, a holding and transferring section situated adjacent to the reservoir, an ascending section for moving the holding and transferring section, and a controlling section for controlling the device. After positioning the holding and transferring section to one side of the storage and delivery sections at a predetermined vertical level by means of the ascending section based on a delivery command, the food item is delivered from the storage and delivery section to the holding and transferring section to hold the food item temporarily. After positioning the holding and transferring section to a vertical level corresponding to a delivery portion, the temporarily held food item is delivered to the delivery portion. The food items can be automatically and quickly delivered.

6 Claims, 4 Drawing Sheets

FOOD STORAGE AND DELIVERY DEVICE

BACKGROUND OF THE INVENTION AND RELATED ART STATEMENT

The present invention relates to a food storage and delivery device that stores solid food items with various kinds, sizes and shapes, such as fried chicken, and automatically delivers or serves specified quantity of specified food items.

Modern fast food restaurants employ a service system in which solid cooked food items with various kinds, sizes and shapes, such as fried chicken, are stored and kept warm, and upon customers' order, the specified food items are delivered for serving. Also, the food items are delivered manually. In case the food items are packed in boxes or bags, automatic vending machines are used for storage and delivery.

The delivery of food items with various kinds, sizes and shapes, such as fried chicken, is generally made manually. In addition, conventional food delivery has other problems. The problems or requirements are listed below.

(1) Stored food items are to be delivered automatically.

(2) Delivery time should be reduced.

(3) Since the size and shape of the food items are not equal, efficiency for storage space is poor, and it is liable to cause trouble for delivery. Sometimes, the delivery can not be made. Thus, reliability is poor.

(4) Mechanisms for storage and delivery of the food items may cause hygienic troubles.

(5) A device for storage and delivery of the food items requires a relatively large space which causes cost increase.

The object of the present invention is to provide a food storage and delivery device that can solve the above problems of the conventional method and device, and stores solid food items with various kinds, sizes and shapes, such as fried chicken and delivers the specified quantity of specified food items automatically. Especially, the device can provide hygienic, convenient and highly efficient food storage space; deliver the food items smoothly from the storage space; and reduce time for food delivery. Also, the device is made compact for reducing space and cost.

SUMMARY OF THE INVENTION

In the present invention, the food storage and delivery device is formed of a reservoir, a holding and transferring section, an ascending section, and a controlling section.

The reservoir includes spiral-type storage and delivery sections placed horizontally and vertically, wherein solid food items are inserted and stored between spiral coils, and are delivered in a specified direction. The holding and transferring section receives the food items delivered from the storage and delivery section disposed horizontally, holds the food items temporarily, and then transfers the food items in the direction perpendicular to the delivery direction of the storage and delivery sections to be located outside the storage and delivery sections. The ascending section raises the holding and transferring section.

The controlling section controls the device. Namely, after positioning the holding and transferring section to a predetermined level by means of the ascending section based on a delivery command, a food item is delivered to the holding and transferring section from the storage and delivery section at the same level as in the holding and transferring section to temporarily hold the food item. After positioning the holding and transferring section to a level corresponding to a delivery location, the temporarily held food item is transferred to the delivery location.

The food storage and delivery device as explained above is formed such that the storage and delivery section has a gutter shape extending in the delivery direction, and includes a mounting tray for the food item and a spiral structure. The spiral structure is positioned such that the inner side of the tray contacts the outer circumference of the spiral, and the delivery direction of the food items corresponds to the central axis of the spiral structure. The tray and the spiral structure can be separated.

The inner side of the tray may have a V-shape. The holding and transferring section includes a conveyer system. The holding and transferring section may be a chute system with a variable inclination angle or a chute system with a fixed inclination angle and a gate at its lower end.

Preferably, a pair of reservoirs is positioned opposite to each other in such a way that the delivery sides of the storage and delivery sections face and sandwich the holding and transferring section.

In the food storage and delivery device of the invention, the holding and transferring section is positioned to a specific level by means of the ascending section based on a delivery command. The food item is delivered to the holding and transferring section from the storage and delivery section at that level and is held temporarily. If necessary, this delivery is repeated. The holding and transferring section is positioned by means of the ascending section to the level corresponding to the delivery location, and then the temporarily held food items are transferred to the delivery location.

Especially, in case the inner side of the tray contacts the outer circumference of the spiral, the central axis of the spiral structure does not bend during a delivery. Also, the tray and the spiral structure can be separated. In case the tray has a V-shaped inner side, the food items in a wide variety of sizes and shapes can be kept in a stable condition, and the tray can hold the spiral structure in order not to bend the central axis of the spiral structure.

In case the reservoirs are positioned opposite to each other, delivery takes place between the reservoirs.

DETAILED DESCRIPTION OF PREFERRED EMBODIMENTS

Figure 1:
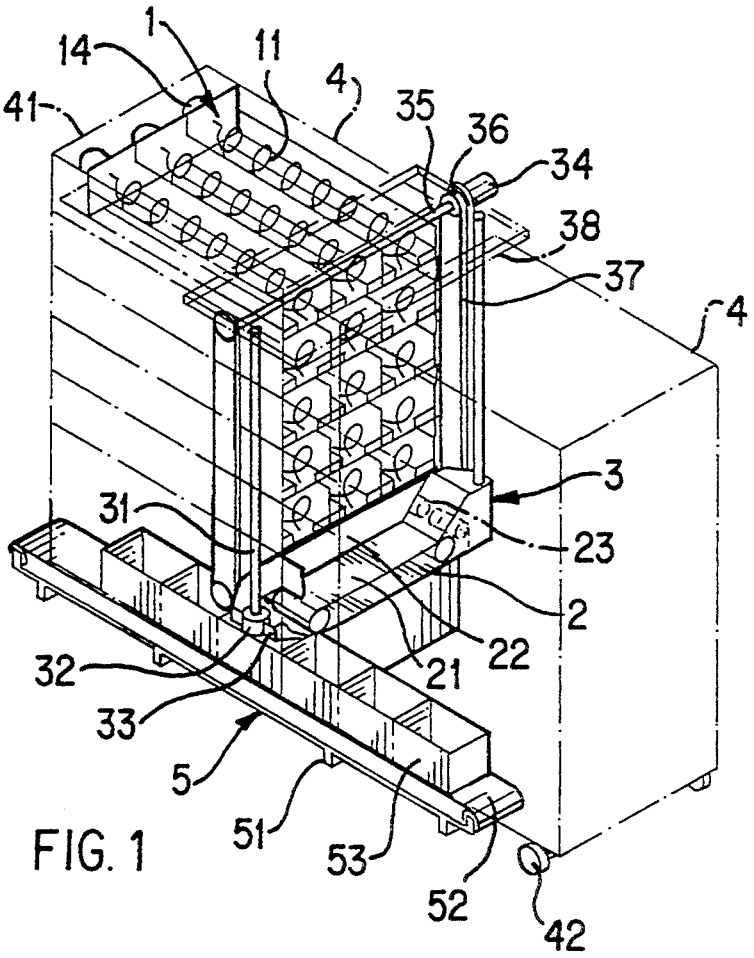
FIG. 1 is a perspective view of an embodiment of the present invention.

An explanation is made for an embodiment of the food storage and delivery device of the present invention with reference to the appended drawings. FIG. 1 is a perspective View of one embodiment of the invention, and structure of the embodiment is described based on FIG. 1.

The food storage and delivery device comprises a pair of reservoirs 4 arranged opposite to each other, and a mechanism for delivering food items from storage and delivery sections 1 of the reservoir 4. The storage and delivery sections 1 are arranged longitudinally and laterally in the form of a matrix. The mechanism for delivering food items is formed of a holding and transferring section 2, an ascending section 3 and a delivery section 5.

The storage and delivery section 1 stores solid food items, such as fried chicken in such a way that the food items are inserted between coils of a spiral 11. When the spiral 11 is rotated at a predetermined angle by a motor 14, a specified amount of the food items is delivered to one side, e.g. right side, of the storage and delivery section.

The storage and delivery sections 1 are arranged laterally in three rows and vertically in six rows to have 18 modules in total in the form of a matrix. The storage and delivery sections 1 are covered by outer walls 41 equipped with wheels 42 to constitute the reservoir 4 at the left side. The reservoir 4 at the left side shares the holding and transferring section 2 and the ascending section 3 with the reservoir 4 at the right side. The reservoirs are arranged opposite to each other so as to sandwich the holding and transferring section 2 and the ascending section 3. Therefore, the best selling food items at the device's location can be stored in 36 storage and delivery sections 1 according to a demand.

The holding and transferring section 2 is located on the food delivery sides of the food storage and delivery sections 1 to receive food items delivered horizontally, to store the food items temporarily and finally to transfer the food items to a predetermined location at the front side away from the storage and delivery sections 1. The holding and transferring section 2 is mainly formed of a conveyer 21, an enclosure 22 for covering the conveyer 21, and a motor 23 to drive the conveyer 21.

The holding and transferring section 2 is mounted on the ascending section 3 for moving the section 2 up and down. The ascending section 3 is basically formed of a pair of vertical guide shafts 31, bearings 32 engaging the shafts 31, an ascending frame 33 attached to the bearings 32 for mounting the holding and transferring section 2, a motor 34 for moving the frame 33, a shaft 35 directly connected to the motor 34, four pulleys 36 arranged at the top and bottom of the reservoir to transfer the rotational force of the shaft 35, and a pair of belts 37 wound around the pulleys 36. The ascending frame 33 is guided along a pair of the guide shafts 31 through the bearings 32. The ascending frame 33 is fixed to the belts 37 and ascends or descends as the belt 37 moves.

Figure 2:
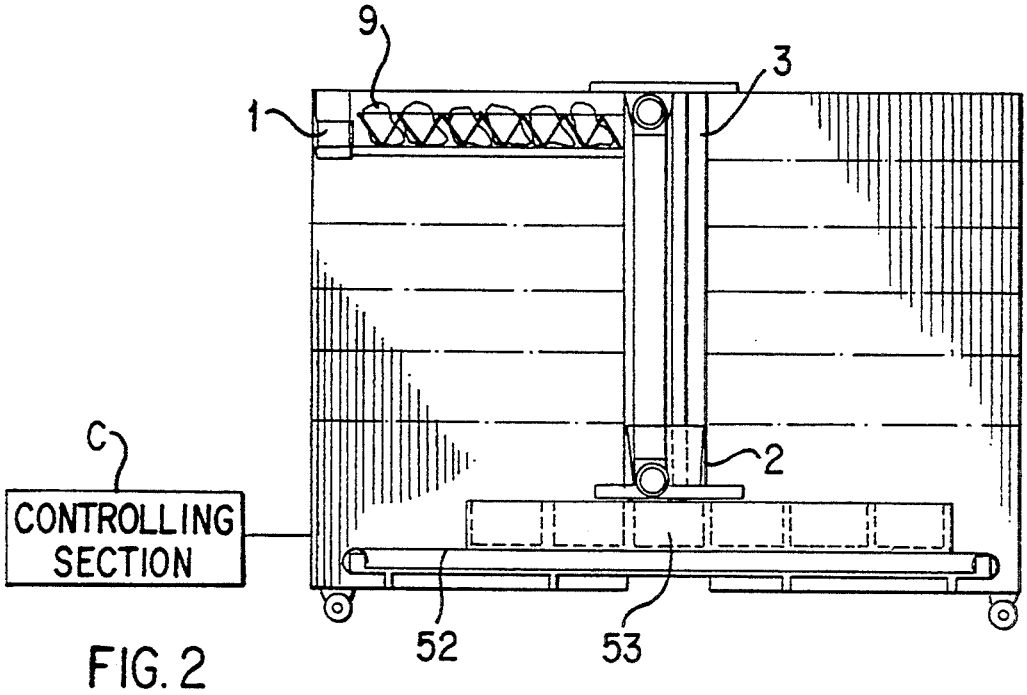
FIG. 2 is a side view of the embodiment of the invention.

The delivery section 5 delivers the food items according to the respective orders of customers through a controlling section C (FIG. 2). The delivery section 5 is basically formed of a base frame 51 attached to the bottom of the reservoir 4, a conveyer 52 placed on the frame 51, and delivery cases 53 mounted on the conveyer 52 to receive the food items according to the orders.

An additional explanation is made relative to the embodiment with reference to the drawings. FIG. 2 is a side view of the embodiment, FIG. 3 is a plan view, and FIG. 4 is a front view thereof.

In FIG. 2, the food items delivered from the storage and delivery section 1 on the left side of the uppermost shelf are transferred onto the holding and transferring section 2 positioned at the level corresponding to the section 1 by the ascending portion 3, and are retained temporarily. When completing the delivery of all the food items 9 in one order onto the section 2, the holding and transferring section 2 descends to the lowermost position as shown in the drawing. The holding and transferring section 2 operates and transfers the temporarily held food items to the delivery case 53 to place the food items therein.

The cases 53 are determined based on the order and are mounted on the conveyer 52 in the order of the customer. The cases 53 move by a unit pitch of the conveyer 52, and receive the ordered food items sequentially from the holding and transferring section 2. The cases 53 holding the food items are moved by the conveyer 52 to the next step, not shown, for the delivery.

Figure 3:
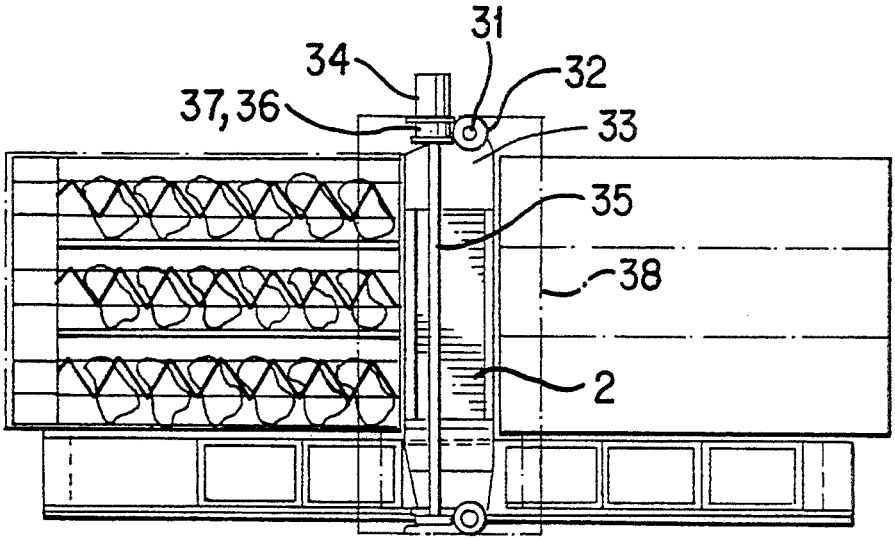
FIG. 3 is a plan view of the embodiment of the invention.
Figure 4:
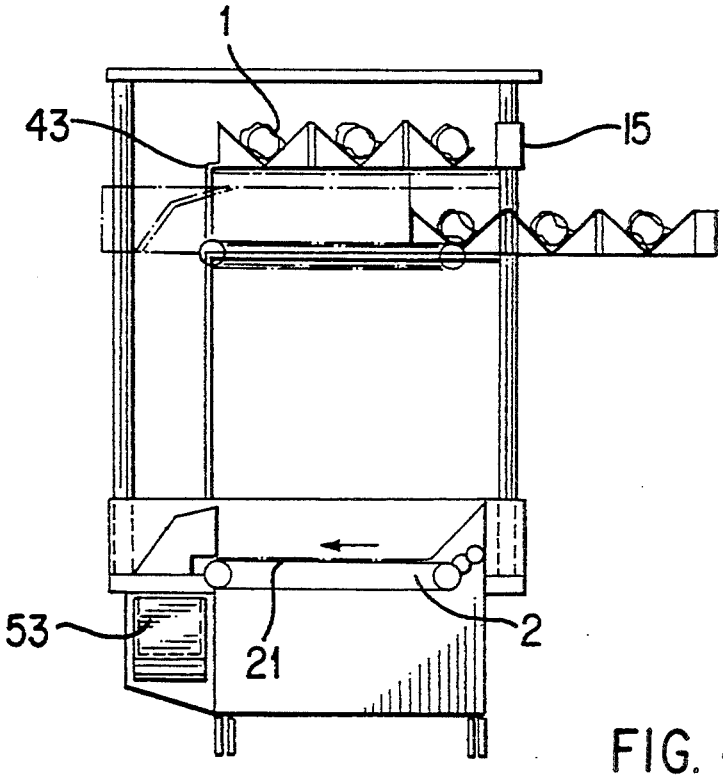
FIG. 4 is a front view of the embodiment of the invention.

In FIG. 3, the ascending frame 33 has two bearings 32 at the upper and lower positions, and moves up and down along the vertically arranged guide shafts 31. On the other hand, a fixed base plate 38 indicated by dotted and dashed lines is placed at the upper most position of the reservoir 4 (refer to the dotted lines in FIG. 1). The shaft 35 is attached directly to the motor 34 fixed to the base plate 38. The ascending frame 33 moves up and down via the pulleys 36 attached to the shaft 35 and the belts 37 wound around the pulleys 36. The holding and transferring section 2 in the form of a conveyer is mounted on the ascending frame 33.

in FIG. 4, three storage and delivery sections 1 are positioned horizontally and housed in a housing frame 15 with a common handle. The three pieces of the storage and delivery sections 1 are inserted as one unit into a shelf 43 in the reservoir 4 from one side thereof.

In FIG. 4, the holding and transferring section 2 moves up and down, and is positioned on a level corresponding to the requested food items as marked by the dotted and dashed lines. At that position, the holding and transferring section 2 receives the food items, stores or holds them temporarily and performs the same things at several levels as required. The Section 2 is finally positioned at the location indicated by the solid lines where the stored food items are transferred to the delivery case 53 by the movement of the conveyer 21.

Figure 5:
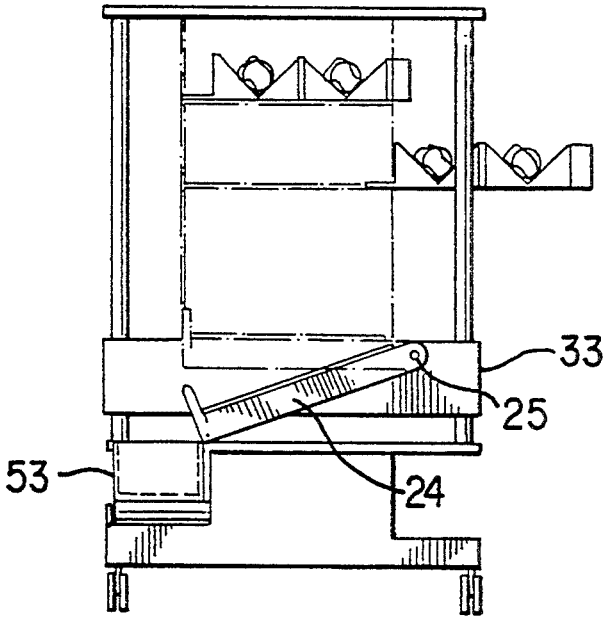
FIG. 5 is a side view of a variation of a holding and transferring section of the invention.

While the holding and transferring section 2 shown in the embodiment is of a conveyer system, other systems are also available. Explanations are given for two variations with reference to the drawings. FIG. 5 is a side view of one variation, and FIG. 6 is a side view of another variation.

The first variation shown in FIG. 5 is of a chute system with a variable inclination angle, wherein a movable chute 24 movable around a shaft 25 is positioned on the ascending frame 33. When the food items are held on the chute temporarily, the movable chute 24 is positioned as shown by the dotted and dashed lines in FIG. 5. When the food items are transferred, the movable chute is lowered down by a motor so as to incline downwardly at the left side as shown by the solid lines, so that the food items held temporarily are transferred to the delivery case 53 by gravity.

Figure 6:
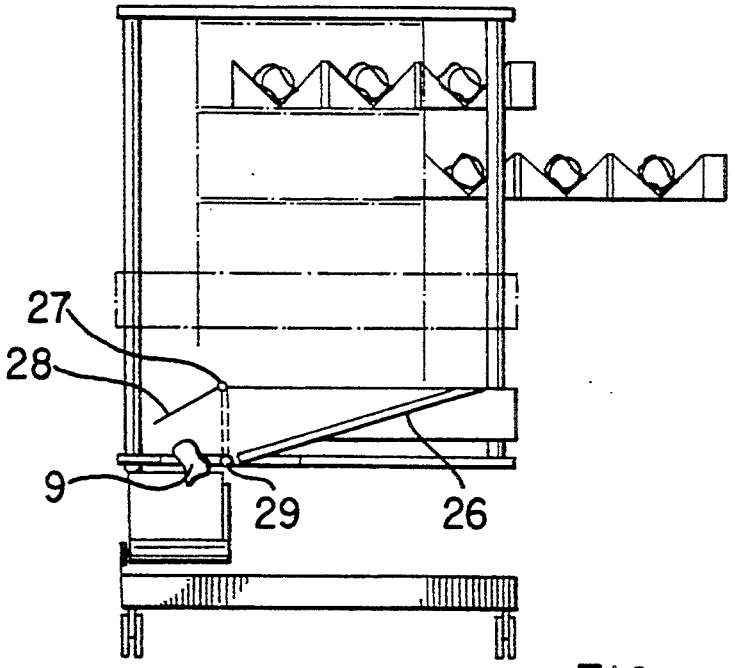
FIG. 6 is a side view of another variation of the holding and transferring section of the invention.

A second variation as shown in FIG. 6 is of a chute system with a gate and a fixed inclination angle. A fixed chute 26 is positioned to incline downwardly at a left end, and a gate 28 movable around a fixed shaft 27 is fixed at the lower end of the chute 26. The gate 28 is normally in a closed position, as shown by the broken lines, to block the food items moving downwardly along the inclined chute 26. The gate 28 is opened to the position marked by solid lines during the delivery of the food items. In this case, a motor is not used to open or close the gate 28, and rather, the food items move by gravity.

The gate 28 is blocked by a solenoid-driven stopper 29 to prevent the gate 28 from rotating in the clockwise direction as a result of gravity working on the food items. The stopper 29 is moved during the delivery of the food items by the solenoid to release the blocked gate 28 and to allow the gate 28 to open in the clockwise direction. As a result, the gate 28 is opened to the position marked by the solid lines to allow the delivery of the food items 9.

Figure 7A:
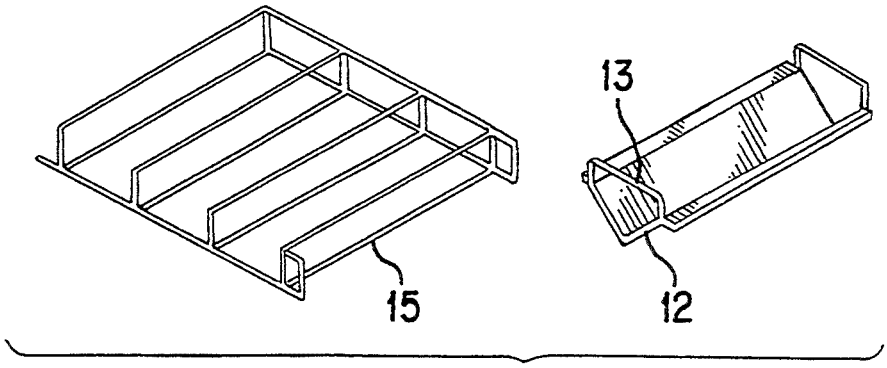
FIG. 7(*a*) is a perspective view of a tray in a disassembled condition, and FIG. 7(*b*) is a perspective view of the tray in an assembled condition.
Figure 7B:
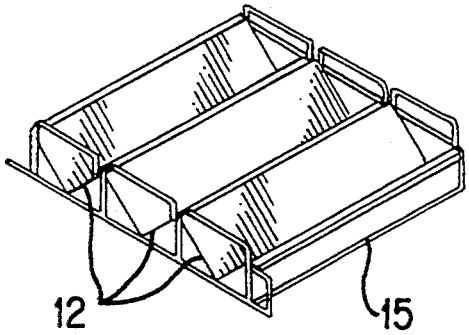
Figure 8:
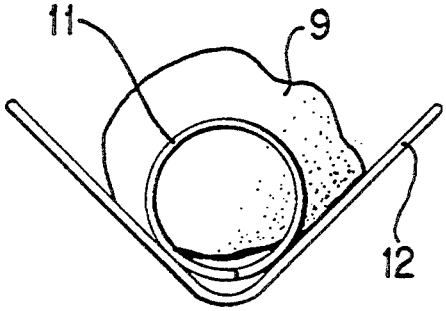
FIG. 8 is a front view of a storage and delivery section of the invention.

In regard to the tray and the spiral structure, an explanation is made with reference to the conventional parts. FIG. 7(*a*) is a perspective view of a tray of the invention in a disassembled condition, and FIG. 7(*b*) is a perspective view of the tray in an assembled condition. FIG. 8 is a front view of the storage and delivery section of the invention.

In FIG. 7(*a*), the tray 12 as one unit is equipped with a handle 13. The housing frame 15 is of a framework structure, and is formed such that three trays 12 can be housed simultaneously. FIG. 7(*b*) shows a state in which three trays 12 are mounted on and stored in the housing frame 15. Since the trays 12 can be disassembled from the housing frame 15, the trays 12 can be cleaned efficiently, thus improving the hygienic aspect of the unit in handling the food items. Also, the housing frame 15 with the trays 12 can be drawn out from the reservoir, so that the food items can be stored easily.

In FIG. 8, the tray 12 has a V-shape, wherein the outer circumference of the spiral 11 contacts the inner side of the tray. Since the tray 12 is V-shaped, even if the sizes and the shapes of the food items 9 are different, the food items 9 and the spiral 11 are positioned stably. This feature is clear when comparing the conventional device, as explained later.

As explained with reference to FIGS. 7(*a*) and 7(*b*), the tray 12 is disassembled from the housing frame 15 to facilitate cleaning. Also, the spiral 11 is removable from a motor (not shown) for easy cleaning. Namely, a motor shaft for the spiral 11 has a slit with a pin, to which the end of the spiral 11 is fixed, to thereby facilitate easy removal.

Figure 9:
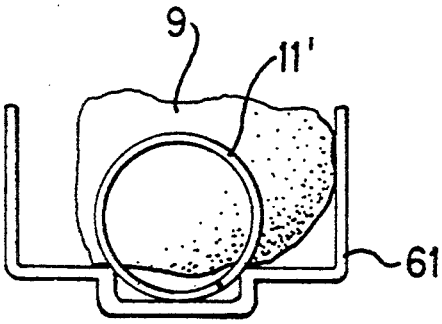
FIG. 9 PRIOR ART
FIG. 9 is a front view of a tray used in a conventional device.
Figure 10:
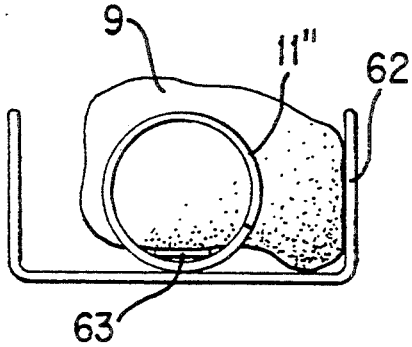
FIG. 10 PRIOR ART
FIG. 10 is a front view of another tray used in the conventional device.

Explanation for the conventional trays are made with reference to FIGS. 9 and 10. FIG. 9 is a front view of one conventional tray, and FIG. 10 is a front view of another conventional tray.

A tray 61 in FIG. 9 has a small U-shaped section protruding from the bottom of the U-shaped tray where a spiral 11' is positioned so that the outer circumference contacts the edges of the U-shaped section. A tray 62 in FIG. 10 includes a main U-shaped body and a band plate 63 placed in a position slightly above the bottom. A spiral 11'' is placed so that the spiral 11'' contacts both sides of the band plate 63 and the bottom face of the tray 62. In either case, the spiral is stabilized in the axial direction. However, in regard to the food items 9, if the sizes vary, particularly in a lateral direction, there may be a trouble. If the size is large, there is no trouble, but if the size is small, there are lateral clearances between the food item and the side wall. Thus, the small food items are stored unstably in the tray. The instability of the food items 9 impedes the smooth transfer of the food items by the spiral. In an extreme situation, transfer of the food items can not be made.

In the food storage and delivery device of the invention, the level of the holding and transferring section is determined by means of the ascending section based on a delivery command, and the food items are supplied to the holding and transferring section from the storage and delivery section at the proper level and are stored temporarily. These actions are repeated as necessary. Finally, the holding and transferring section is positioned by the ascending section to the level corresponding to the delivery location, and the food items are transferred to the delivery location.

Accordingly, there are following advantages; (1) the food items can be delivered automatically, (2) since the storage and delivery section has a spiral structure, even if the sizes and shapes of the food items are different, the insertion of the food items can be made easily and the transfer can be made reliably, (3) steps for delivery can be reduced, and (4) errors in selecting the kinds of the food items to be delivered can be prevented.

In case the spiral structure contacts the inner side of the tray, the spiral structure does not bend while transferring, so that smooth delivery of the food items can be made. In addition, the tray and the spiral structure can be disassembled, so that the components can be cleaned and are good on hygiene.

In case the tray has a V-shape, the solid food items in a wide variety of sizes and shapes can be kept in a stable condition. Also, the spiral structure can be positioned linearly without bending, so that the food items can be delivered smoothly, efficiency of the storage space is improved, and reliability of delivery can be improved.

In case the holding and transferring section has a conveyer system, the food items may not stack together, so that the food items can be transferred surely. In case of the chute system with a variable inclination angle, the food items may not stack together, and the structure is simple. In case of the chute system with a fixed inclination angle and a gate, since the movable part is the gate only, the structure can be further simplified, and cleaning can be made easy.

In case the reservoirs are placed opposite to each other to sandwich the holding and transferring section at the delivery sides, the delivery mechanisms, such as the holding and transferring section and the ascending section, can be shared. Thus, the kinds and amounts of the food items can be doubled with a small amount of additional cost and required space.

While the invention has been explained with reference to the specific embodiments of the invention, the explanation is illustrative, and the invention is limited only by the appended claims.

What is claimed is:

1. A food storage and delivery device, comprising:

a reservoir having spiral type storage and delivery sections arranged horizontally and vertically, each storage and delivery section extending in a longitudinal direction and having a tray and a rotatable spiral structure positioned on the tray contact thereto so that solid food items are held between pitches of the spiral structure and delivered in one direction, said tray receiving the food items thereon and having an inner side with a V-shape, said spiral structure being positioned in the V-shape inner side, and being able to disassemble from the tray, a holding and transferring section situated adjacent to the reservoir for receiving the food items from the storage and delivery section, said holding and transferring section holding the food item transferred from the storage and delivery section temporarily and transferring the food item to a delivery portion, an ascending section for moving the holding and transferring section, and a controlling section for controlling the storage and delivery sections, the holding and transferring section and the ascending section such that after positioning the holding and transferring section to one side of the storage and delivery sections at a predetermined vertical level by means of the ascending section based on a delivery command, the food item is delivered from the storage and delivery section to the holding and transferring section to hold the food item temporarily, and after positioning the holding and transferring section to a vertical level corresponding to the delivery portion, the temporarily held food item is delivered to the delivery portion.

2. A food storage and delivery device according to claim 1, wherein said holding and transferring section has a conveyer system for delivering the food item on the conveyer to the delivery portion.

3. A food storage and delivery device according to claim 1, wherein said holding and transferring section has a chute system with a variable inclination angle, said chute system being inclined when the food item is delivered to the delivery portion.

4. A food storage and delivery device according to claim 1, wherein said holding and transferring section has a chute system with a fixed inclination angle, said chute system having a gate at a lower end so that the gate is opened when the food item is delivered to the delivery portion.

5. A food storage and delivery device according to claim 1, wherein two reservoirs are arranged opposite to each other such that delivery directions face against each other and the holding and transferring section is situated between the two reservoirs.

6. A food storage and delivery device according to claim 1, wherein said controlling section controls the holding and transferring section such that when a plurality of the food items are to be delivered to the delivery portion, said plurality of the food items are, at first, transferred to the holding and transferring section, and the food items on the holding and transferring section are delivered to the delivery portion at a time.

* * * * *